United States Patent [19]

D'Andolfo et al.

[11] Patent Number: 4,675,142

[45] Date of Patent: Jun. 23, 1987

[54] SINGLE-STAGE PROCESS FOR THE HIGH SPEED PRODUCTION OF CONTINUOUS POLYAMIDIC-BASE SYNTHETIC THEREADS, AND PRODUCTS OBTAINED THEREBY

[75] Inventors: Francesco D'Andolfo, Cesano Maderno; Fulvio Grampa; Giuseppe Mazzacchera, both of Busto Arsizio; Aurelio Rolando, Milan, all of Italy

[73] Assignee: Snia Fibre S.p.A., Cesano Maderno, Italy

[21] Appl. No.: 688,151

[22] Filed: Dec. 31, 1984

[30] Foreign Application Priority Data

Dec. 30, 1983 [IT] Italy ..... 24457 A/83

[51] Int. Cl.[4] ..... D04G 5/00; D06B 15/00

[52] U.S. Cl. ..... 264/103; 264/211.5; 264/500; 264/571; 57/350; 57/908

[58] Field of Search ..... 264/103, 211.15, 500, 264/571; 28/271, 272, 274; 57/350, 908

[56] References Cited

U.S. PATENT DOCUMENTS

| | | | |
|---|---|---|---|
| 3,110,151 | 11/1963 | Bunting, Jr. et al. | 57/908 |
| 4,035,464 | 7/1977 | Kubitzek et al. | 264/103 |
| 4,051,660 | 10/1977 | Griset, Jr. | 57/908 |
| 4,102,965 | 7/1978 | Kubitzek et al. | 264/103 |
| 4,125,922 | 11/1978 | Irwin | 28/274 |

*Primary Examiner*—Jan H. Silbaugh
*Assistant Examiner*—Hubert C. Lorin
*Attorney, Agent, or Firm*—Wenderoth, Lind & Ponack

[57] ABSTRACT

A method of high-speed spinning polyamidic fiber, comprising the steps of extruding the polymer in the molten state, cooling the filaments by blowing, and finishing, which is performed in two stages, one upstream and the other downstream of the interlacing device.

The latter device includes a containing enclosure wherein the interlacing nozzle and at least two pairs of yarn thread guides are accommodated.

Fibers obtained with the method have 5 to 29 knots per meter.

13 Claims, 1 Drawing Figure

SINGLE-STAGE PROCESS FOR THE HIGH SPEED PRODUCTION OF CONTINUOUS POLYAMIDIC-BASE SYNTHETIC THEREADS, AND PRODUCTS OBTAINED THEREBY

BACKGROUND OF THE INVENTION

1. Field of the Invention

This invention relates to a continuous single-stage high-speed spinning method for polyamidic multifilament yarns composed of specially suitable polymers for use as PA6 (Nylon 6) for the extrusion of molten polymer through dies and collection of the yarn at rates in the 3,500 to 5,500 meters/minute range, directly usable in standard textile operations without any further treatments.

2. Prior Art

It is known that multifilament yarns of PA6 are produced by means of different processing cycles using methods of the discontinuous or continuous types.

In general, in the instance of discontinuous methods, production takes place in two stages: spinning at a picking rate of about 800 to 1200 m/min followed by stretching, during which step the multifilament threads are stretched to values ranging from 3 to 4 times their initial lengths.

The stretching operation imparts the yarns with the desired final characteristics making it suitable for subsequent processing.

Such discontinuous methods normally require considerable involvement in terms of investments for the required equipment to implement them, and a high cost for the operation of such lines in terms of labor and effort.

In the instance of continuous methods, instead, a so-called combined spinning and stretching technique is used.

Compared to methods of the discontinuous type, extrusion through the dies take place at comparable values to those used in the discontinuous methods, but the stretching step takes place in a separate section from spinning, although in-line on the same equipment and at much higher rates than with the two-stage process.

With that equipment, the yarn picking speed is generally much higher than with the discontinuous process, and reaches levels on the order of 3,000 to 5,000 meters/minute.

Even in that case, however, the desired textile properties are imparted to the yarn by the stretching station, i.e. by the assembly comprising two or more spinning rollers normally intended for such an operation and always present in equipment of this type.

The presence of rotary members wherearound the yarn is passed is undesirable both as a way of reducing installation costs and because of the problems which arise in connection with the operation of such items, always costly, e.g. of the maintenance problems.

Single-stage continuous spinning processes have already been proposed at the rates contemplated by this invention and without stretching rollers, but the yarns obtained thereby are of the so-called POY (Partially Oriented Yarn) type and require an additional processing step (additional stretching or texturizing-stretching) in order for them to be regarded as finished and ready for use.

Also known is that at higher speeds, in excess of 5,500 meters/minute, it is possible to obtain some of the yarn characteristics sought, without stretching or spinning rollers, the orientation achieved at the die being already adequate to impart it with some satisfactory textile characteristics, i.e. low recovery and a suitable initial elastic modulus.

In general, however, one is liable to encounter considerable problems from two substantial standpoints: quality of the yarn and output rate. Under the former aspect, the problems are connected with the fact that the high operating tensions imposed by the high picking rate, do not permit a sufficient and regular number of interlacings to be obtained as required by modern high speed yarn processing methods and without prior retwisting.

Furthermore, the need for imparting to the yarn a desired and necessary amount of finishing oil with the required regularity, and the fact that in processing PA6, for a correct formation of the packages, the yarn must be imparted with a substantial amount of moisture, creates a considerable problem of pollution of the working environment; therein, owing to the high speed of the yarn and the presence of thread cohesioning members (consisting of nozzles wherefrom high pressure air is ejected), atomizing of the added products (water and finishing agents) is quite high owing to the vibrations induced by the cohesioning fluid jet in the yarn. Such atomizing is highly harmful and undesired.

As to the output rates, single-stage processes at so high speeds, and in general all those (even at lower speeds) which are carried out without stretching rollers or other devices for reducing the tension on the thread during extrusion and picking, cause an extremely high number of breakages during the copping step, with considerable attendant waste production.

Furthermore, owing to the high operating tensions, the yarn interlacings are generally insufficient and irregularly distributed along the entire wound yarn.

Finally, the aforementioned difficulties of an irregular take-up of water finish result in the formation of irregular packages, which are consequently difficult to unwind in the course of subsequent processing steps.

SUMMARY OF THE INVENTION

It is a primary object of this invention to obviate the aforementioned problems by providing a method of producing continuous polyamidic polymer yarns at speeds in the 3,500 to 5,500 meters per minute range, comprising the steps of extruding the polymer in the molten state through multiple orifice dies, cooling the filaments by blowing, finishing them and interlacing them, wherein: (a) said finishing step is performed in two stages, the first of said stages taking place upstream of said interfacing and the second downstream of said interlacing; (b) said interlacing is performed within an enclosure accommodating the intake nozzle for the interlacing fluid jet and at least two pairs of yarn guides for contact with said filaments therein, the one upstream and the other downstream of said nozzle, and having at least one intake port for drawing said interlacing fluid in amounts at least equal to those admitted by said nozzle.

A further object of this invention is to provide a fiber of polyamide 6 obtained by means of said method.

DETAILED DESCRIPTION OF THE PREFERRED EMBODIMENTS

Figure 1:
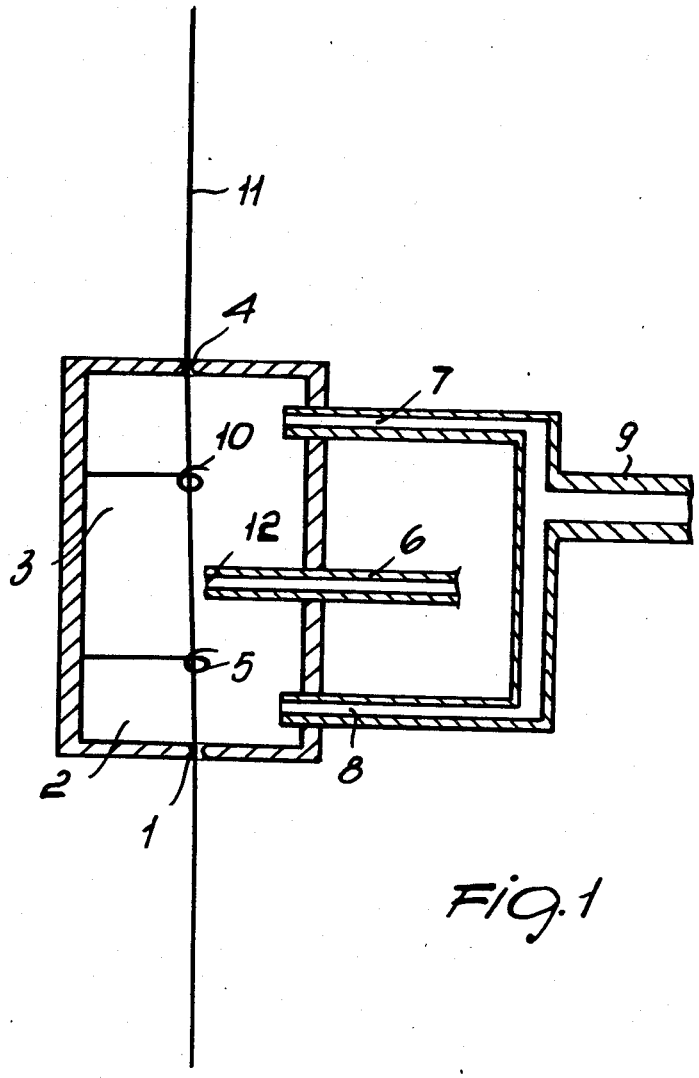

Further features and advantages of the invention will be more clearly apparent from the description of some preferred, though not exclusive, embodiments of the method, with reference to the accompanying illustrative, but not limitative, drawing, where:

FIG. 1 is a sectional view, taken in a parallel plane to the yarn direction, of the interlacing enclosure.

Making reference to FIG. 1, this method consists, as further explained in the Examples herein below, of spinning polyamidic polymers, as comprising, for instance, polyamide 6 (Nylon 6).

The extruded filaments undergo a cooling treatment by blowing with a fluid comprising, of preference, air at room temperature. This blowing treatment engages a yarn section about 800 mm long.

Subsequently, a first finishing treatment is provided which is located at a relatively short distance from the die plane, which varies as mentioned between 90 and 130 cm. Such a reduced distance allows the friction between the yarn and air to be reduced thanks to the individual filaments being reunited into a microfilament and, hence, the yarn tension at the successive interlacing and picking area. Owing to the very high speed employed, the frictional values of the frictions encountered by the yarn on its path are important in determining the tension adjusted in the final section of the yarn, prior to picking. Thus, only if that tension is below certain critical limits which are typical of each yarn, one can obtain a satisfactory interlacing and picking without breakage and production of waste.

The finishing treatment, preferably located at a distance of 110 cm from the die plane, is preferably carried out by a double tier of opposed finishing nozzles.

Such finishing nozzles are fed with a much diluted emulsion of lubricant oil in water. There is no need for this lubricant oil to have all of the characteristics which are required of a standard finishing oil, which are dependent on such subsequent processing steps as rewinding, texturing and weaving. Thus, the lubricant oil supplied in emulsion form to these first finishing nozzles will only have substantially lubricating properties. Such an oil may be selected from a wide range of lubricating oils which are available and known to the skilled ones as lubricants composed of fatty acid esters such as butyl stearate.

The emulsion of such lubricant oils in water comprises 0.2% to 1% by weight lubricant oil and preferably 0.5% to 0.8% by weight lubricant oil.

The steps described so far have not been exemplified in FIG. 1 for simplicity, this Figure illustrating the interlacing treatment which comes next to the first finishing treatment just described.

Said interlacing step is carried out within an enclosure comprising, for example, a container 3. Accommodated inside the container 3 is a nozzle 12 feeding out the jet of interlacing fluid, such as air under pressure. The operating pressures are preferably in the 2 to 8 $kg/cm^2$ range.

The container structure further includes two pairs of yarn guides in contact with the filaments 11. The first of such pairs comprise, for example, yarn guides 4 and 10, and the second comprise yarn guides 1 and 5.

The yarn guides are positioned inside the container such that the filament 11 is at all times in contact with the surface of the yarn guide.

The first pair 4,10 of yarn guides are located upstream of the nozzle 12 and the second pair are located downstream of the nozzle 12. The yarn guides in each of said pairs engage a section of the yarn which is no shorter than 50 mm.

The container 3 is also provided with at least one port, in the example ports 7 and 8 having being used, for drawing in the amounts of air admitted by the nozzle 12. The mass air flow rate through the ports 7 and 8 will be equal at least to that issuing from the nozzle 12.

Of course, also drawn in through the ports 7 and 8 would be the mists, produced by the shaking and vibrating effects connected with interlacing, of the liquid applied to the yarn by the first finishing step.

It has been ascertained in actual practice that the above-described configuration allows of perfect drawin of all the mist produced. Further, the double pair of yarn guide used prevent the stresses undergone by the yarn on account of the jet of interlacing fluid, from being transferred to the yarn sections lying outside of the container 3.

Preferably, the flow rate through the intake ports 7 and 8 would be adjusted to create, inside the container 3, a vacuum of about 0.8 mm $H_2O$. It is preferable, however, to operate such as to maintain said vacuum at a level below 1 mm $H_2O$.

In a preferred embodiment, the container 3 engages a yarn section no longer than 30 cm. The internal volume of the container is smaller than 900 $cm^3$.

After that interlacing treatment, the yarn is subjected to the second finishing step, which is carried out using a concentrated emulsion of oil in water at an oil content of 5% to 100%.

The finish oil employed during this second step, additionally to its lubricating properties, should also have cohesiving properties, and antistatic, thermal stability, and emulsifiable in stable form properties, as well as hydrophilic properties.

The method described allows the final content of finish oil or grease on the fiber to be kept within the desired percentage.

In the preferred embodiment, the finish oil on the fiber is provided in amounts from 0.2% to 2%, and preferably from 0.4% to 1.4% by weight.

This invention also enables the regularity of the finish oil distribution to be controlled such that the greatest variations from the average value are around 20% of the average value.

The resulting fibers comprise 5 to 20 knots per meter, preferably 10 to 15 knots per meter.

The following examples have been conducted in accordance with the above method.

EXAMPLE 1

The first finishing step takes place at a distance of 110 cm from the die plane, and the emulsion contains 0.5% butyl stearate.

The second tier of nozzles are fed with an emulsion of finish oil (BK 1840 from Henkel GmbH) for continuous polyamidic threads at 30% water.

The other characteristics of the yarn and the method are shown in the accompanying Table 1.

The yarn is picked at a rate of 4,000 meters per minute. The finish consumption is 1.30 kg per 100 kg produced yarn.

The finish oil content on the fiber is 1% by weight. From Table 1, the degree of regularity in the distribution of grease over the fiber may be appreciated. The maximum grease distribution variation is 15% of the average value which is 1% by weight.

EXAMPLE 2

The yarn is produced in accordance with Example 1, excepting that the first finishing step takes place at a distance of 90 cm from the die plane and contains 0.8% by weight of lubricating oil.

The second tier of nozzles are fed with pure finish oil, with no water. The yarn characteristics are as shown in Table 1. The maximum variation in the grease distribution over the fiber is 18% of the average value, which is 1% by weight.

EXAMPLE 3

This example has been conducted as a comparative example to bring out the kind of problems to be encountered when interlacing is effected without the above-described enclosure on a yarn which is being picked at a rate of 4,000 m/min.

It may be appreciated from Table 1 that, in the absence of the enclosure and double pair of yarn feeding rings, the finish oil consumption increases to 2.51 kg per 100 kg picked yarn.

Thus, it appears that for each 100 kg produced yarn, over 1 kg finish fluid is atomized and scattered through the working environment.

Maximum variation of the grease distribution over the fiber is 35% of the average value, which is 1% by weight.

EXAMPLE 4

Example 4 has been conducted like Example 1, excepting that the yarn rate is over 4,500 meters per minute.

Maximum variation of the finish grease over the fiber is 18% of the average value which is 1.36% by weight.

EXAMPLE 5

This Example has been conducted like Example 2, excepting that the picking rate is 4,500 meters per minute.

Maximum variation of the finish grease distribution over the fiber is 19% of the average value which is 1.32% by weight.

EXAMPLE 6

This Example has been conducted as a comparative example with respect to Examples 4 and 5. Also in this case, as with comparative Example 3, without using the method disclosed by this invention, the finish oil consumption is much higher, and accordingly, contamination of the working area is correspondingly much higher.

Maximum variation of the finish grease distribution over the fiber is 40% of the average value, which is 1.34% by weight.

TABLE I

| | EXAMPLES | | | | | |
|---|---|---|---|---|---|---|
| | 1 | 2 | 3 | 4 | 5 | 6 |
| USTER (%) | 1.2 | 1.3 | 1 | 1 | 1.1 | 1.3 |
| COUNT (dtex/filaments) | 70/18 | 70/18 | 70/18 | 44/12 | 44/12 | 44/12 |
| SPEED (m/min) | 4000 | 4000 | 4000 | 4500 | 4500 | 4500 |
| PERCENT ELONGATION | 64 | 64.5 | 63 | 61 | 61.5 | 61 |
| TENACITY (cN/TEX) | 37.3 | 37.6 | 37.1 | 35.3 | 35.5 | 33 |
| MODULE (cN/TEX) | 137 | 133 | 138 | 137 | 137 | 138 |
| PERCENT SHRINKAGE | 9 | 9 | 9.1 | 8.9 | 9 | 8.9 |
| INTERLACING AIR PRESSURE ($kg/cm^2$) | 4 | 5 | 5 | 6 | 6 | 6 |
| KNOTS PER METER | | | | | | |
| MEDIUM | 12 | 12 | 10 | 15 | 15 | 13 |
| MINIMUM | 10 | 11 | 7 | 13 | 12 | 5 |
| MAXIMUM | 14 | 13 | 13 | 17 | 18 | 19 |
| FINAL FINISH OIL OVER THE FIBER (% BY WEIGHT) | | | | | | |
| MEDIUM | 1% | 1% | 1% | 1.36% | 1.32% | 1.34% |
| MINIMUM | 0.92% | 0.91% | 0.83% | 1.49% | 1.45% | 1.61% |
| MAXIMUM | 1.07% | 1.09% | 1.18% | 1.24% | 1.20% | 1.07% |
| FINISH CONSUMPTION (kg per 100 kg yarn) | 1.30 | 1.27 | 2.51 | 1.51 | 1.48 | 2.67 |

We claim:

1. A method of producing, by direct spinning, continuous polyamidic polymeric yarns at rates in the 3,500 to 5,500 meters per minute range, consisting of, in the following sequence, the steps of extruding the polymer in the molten state through a planar multiple orifice die, cooling the filaments by blowing and:
   (a) lubricating the filaments with an emulsion of lubricating oil in water, containing oil in the range from 0.2% to 1% by weight;
   (b) interlacing the filaments within an enclosure accommodating an interlacing fluid jet feeding nozzle and at least two pairs of yarn guides in contact with said filaments therein, one pair being located upstream and the other downstream of said nozzle, said enclosure being provided with at least one port for sucking out the interlacing fluid in an amount at least equal to that admitted by said nozzle;
   (c) lubricating the filaments with an emulsion of lubricating oil in water containing oil in the range from 5% to 100% by weight; and
   (d) winding up the yarn on a reel at the rate of 3,500 to 5,500 meters per minute;
   step (a) being performed upstream of step (b) and step (c) being performed downstream of step (b), whereby the end fibers contain an amount of finish oil with a variation from the average value, on the reel on which they are wound, lower than 20%, and have 5 to 29 knots per meter.

2. The method according to claim 1, wherein the lubricating oil in step (a) is applied to said filaments via a double tier of opposed nozzles adjacent the plane of said die.

3. The method according to claim 2, wherein said nozzles for step (a) are located at a distance from the die plane not exceeding 130 cm.

4. The method according to claim 2, wherein said lubricating oil for step (a) is a dilute emulsion of lubricating oil in water.

5. The method according to claim 4, wherein said lubricating oil comprises butyl stearate.

6. The method according to claim 4, wherein said emulsion contains 0.5% to 0.8% lubricating oil by weight.

7. The method according to claim 1, wherein step (c) comprises finishing with a concentrated emulsion of oil in water.

8. The method according to claim 1, wherein the mass flow rate of said port is higher than the mass flow rate of the interlacing fluid jet feeding nozzle.

9. The method according to claim 8, wherein said port creates within said enclosure a vacuum not exceeding 1 mm $H_2O$.

10. The method according to claim 1, wherein said enclosure engages a yarn section no longer than 30 cm.

11. The method according to claim 1, wherein said enclosure has a volume not exceeding 900 $cm^3$.

12. The method according to claim 1, wherein said yarn guide comprises a yarn feeding finger, the yarn feeding fingers of each of said yarn guide pair engaging a yarn section no shorter than 50 mm.

13. The method according to claim 1, wherein the interlacing fluid jet is fed at a pressure in the 2 to 8 $kg/cm^2$ range.

* * * * *